US011628327B1

(12) United States Patent
Roberson

(10) Patent No.: US 11,628,327 B1
(45) Date of Patent: Apr. 18, 2023

(54) ABDOMINAL EXERCISE MACHINE

(71) Applicant: Michael R. Roberson, Fresno, CA (US)

(72) Inventor: Michael R. Roberson, Fresno, CA (US)

( * ) Notice: Subject to any disclaimer, the term of this patent is extended or adjusted under 35 U.S.C. 154(b) by 0 days.

(21) Appl. No.: 17/974,486

(22) Filed: Oct. 26, 2022

(51) Int. Cl.
*A63B 21/075* (2006.01)
*A63B 23/02* (2006.01)
*A63B 21/00* (2006.01)

(52) U.S. Cl.
CPC ..... *A63B 21/075* (2013.01); *A63B 21/4035* (2015.10); *A63B 23/0205* (2013.01); *A63B 2225/093* (2013.01)

(58) Field of Classification Search
CPC ..... A63B 21/075; A63B 21/4035; A63B 23/0205; A63B 23/0211; A63B 23/0216; A63B 23/0222; A63B 23/0227; A63B 2225/093
See application file for complete search history.

(56) References Cited

U.S. PATENT DOCUMENTS 5,897,472 A 4/1999 Thulasingam
5,913,756 A 6/1999 Glaser
5,954,622 A * 9/1999 Olschansky ..... A63B 21/4011 482/133
6,447,434 B1 9/2002 Waters
7,569,003 B1 * 8/2009 Huffman ..... A63B 21/4045 482/111
7,674,209 B2 * 3/2010 Greene ..... A63B 21/02 482/121
7,789,817 B2 9/2010 Wang
7,896,785 B1 * 3/2011 Marcus ..... A63B 21/4015 482/111
8,092,354 B2 1/2012 Oller, Jr.
D671,178 S 11/2012 Sip
9,289,639 B1 3/2016 Colby
9,616,285 B2 * 4/2017 Todd ..... A63B 23/03533
9,868,024 B2 * 1/2018 Castelluccio ..... A63B 23/0211
2002/0111256 A1 * 8/2002 Tuller ..... A63B 23/0244 482/140
2007/0238588 A1 * 10/2007 Butler ..... A63B 21/4035 482/77
2015/0038301 A1 * 2/2015 Todd ..... A63B 21/0615 482/97
2020/0147439 A1 * 5/2020 Acuna, Jr. ..... A63B 21/4035

* cited by examiner

*Primary Examiner* — Joshua Lee
(74) *Attorney, Agent, or Firm* — Cramer Patent & Design, PLLC; Aaron R. Cramer

(57) ABSTRACT

The abdominal exercise machine may comprise an upper armature, a lower armature, a central bar, and a plurality of weight discs. The abdominal exerciser may be adapted to be lifted by a user in order to perform one or more resistance training exercises. The upper armature may be adapted to be grasped by the user while the user lifts the abdominal exerciser. The plurality of weight discs may detachably couple to the central bar in order to establish the amount of resistance to lifting. The lower armature may elevate the plurality of weight discs and the upper armature. The vertical height of the plurality of weight discs and the upper armature be telescopically adjusted for the comfort and safety of the user. The abdominal exercise machine may be suspended from a pair of hooks of an equipment stand when not in use.

20 Claims, 2 Drawing Sheets

ABDOMINAL EXERCISE MACHINE

RELATED APPLICATIONS

Not applicable.

FIELD OF THE INVENTION

The presently disclosed subject matter is directed to an exercise machine and more specifically to an abdominal exercise machine.

BACKGROUND OF THE INVENTION

Physical fitness and health concerns are among the areas of highest concern among Americans today. More than ever, people are frequenting health clubs and performing exercise routines at home in order to lose weight, improve muscle tone and maintain a healthy lifestyle. One area that many people concentrate on is their abdominal and adjacent muscle area. Typically called "love handles", this area around one's waist is usually very difficult to reduce with standard workout machines, as most of these machines work on arms, legs, and chest areas. Accordingly, there is a need for means by which exercise workout equipment can specifically target the abdominal area without the disadvantages as listed above. The development of the abdominal exercise machine fulfills this need.

SUMMARY OF THE INVENTION

The principles of the present invention provide for an abdominal exerciser has an upper armature having a first handle, a second handle, and an upper vertical armature, a central bar having a plurality of height adjustment apertures disposed on an upper half and a lower half of the central bar such that one or more upper height adjusters engage the height adjustment apertures located on the upper half of the central bar and one or more lower height adjusters engage the height adjustment apertures located on the lower half of the central bar, a plurality of weight discs detachably coupled to the central bar in order to establish an amount of resistance to lifting, and a lower armature elevating the weight discs and the upper armature.

The upper armature may be adapted to be grasped by a user while the user lifts the abdominal exerciser. The abdominal exerciser may be adapted to tighten a plurality of core abdominal muscles and strengthen a plurality of upper body muscles. An outside diameter of the upper vertical armature may be smaller than an inside diameter of the central bar such that the upper vertical armature slides up and down within the central bar. The upper armature may be a tee-shaped armature.

The first handle and the second handle may be horizontally-oriented colinear shafts. The second end of the first handle and the first end of the second handle may be coupled on top of the upper vertical armature. The first handle may include a first handle pad and a second handle pad to cushion the first handle and the second handle. The upper vertical armature may include the one or more upper height adjusters that engage one or more apertures located on the central bar in order to retain the upper vertical armature at a fixed vertical position relative to the central bar.

The one or more upper height adjusters may be one or more spring-loaded buttons. The first handle and the second handle each may include a handle downturn that is a second-angle downward bend at the distal end of the first handle and the second handle. The height adjustment apertures may be arranged in pairs located on opposite sides of the central bar. A first set of height adjustment apertures may be radially separated from a second set of height adjustment apertures by 90 degrees such that the upper armature is rotated to be orthogonal with the lower armature. A vertical height of the weight discs and the upper armature may be telescopically adjusted for comfort and safety.

The handle downturns may be operable to prevent limit laterally sliding of the upper armature by interfering with a pair of hooks on an equipment stand as the upper armature slides. The central bar may include a first weight rod and a second weight rod that are horizontally-oriented colinear shafts extending from the center of the central bar. The first weight rod and the second weight rod may be operable to retain the weight discs. The weight discs may slide onto the first weight rod and the second weight rod by passing the first weight rod and the second weight rod through a plurality of central weight apertures of the weight discs. The first weight rod may include a first retainer hole and a first retainer pin coupled to the first weight rod via the first retainer hole to retain the weight discs on the first weight rod. The second weight rod may include a second retainer hole and a second retainer pin coupled to the second weight rod via the second retainer hole to retain the weight discs on the second weight rod.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
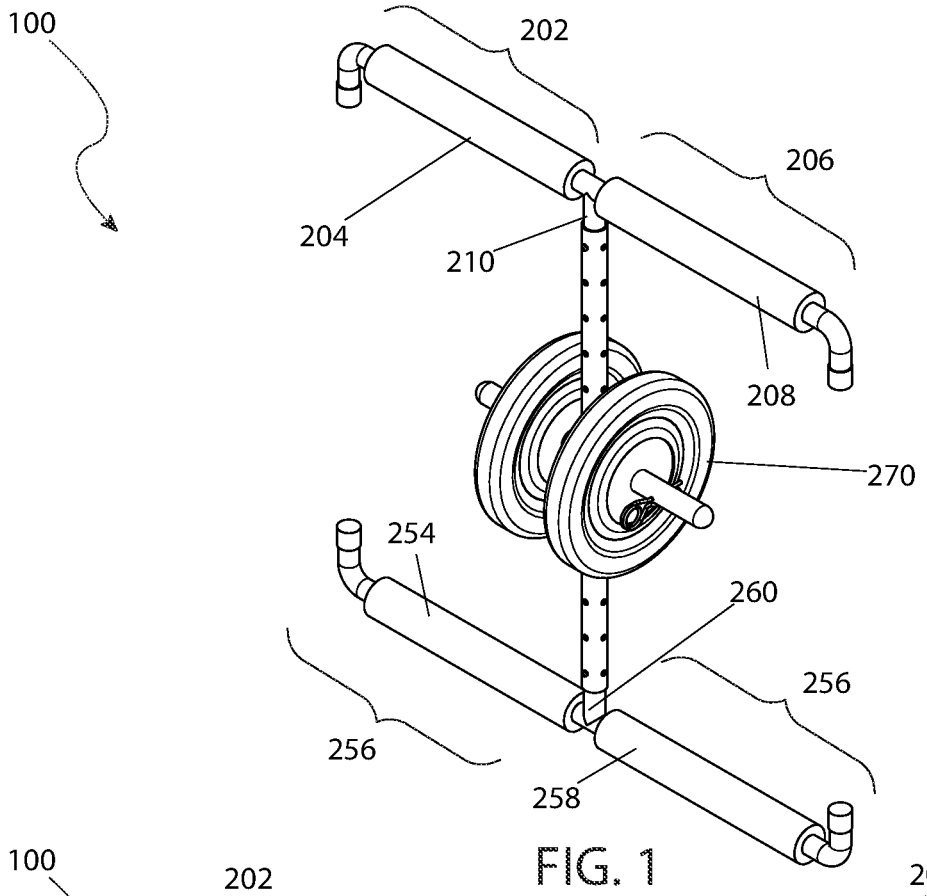
FIG. 1 is an isometric view of an abdominal exerciser, according to an embodiment of the present invention.
Figure 2:
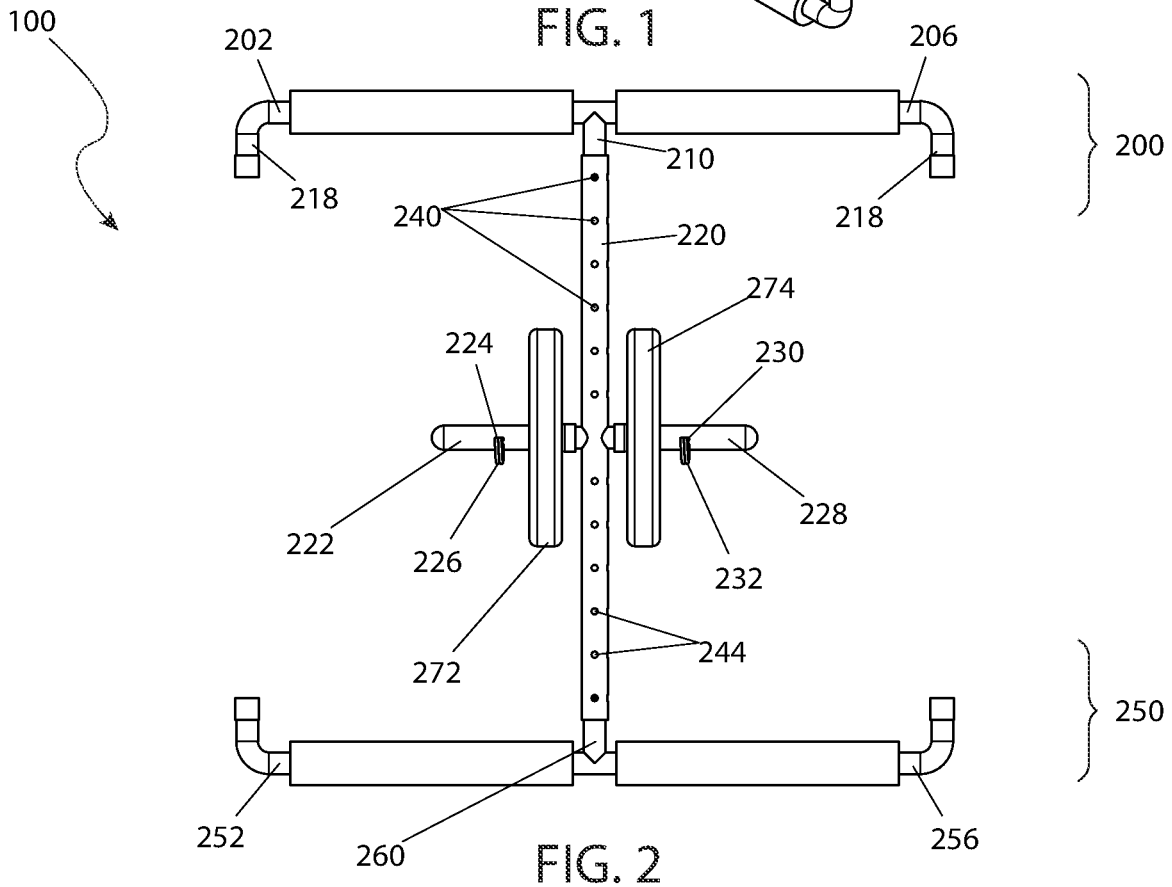
FIG. 2 is a front view of an abdominal exerciser, according to an embodiment of the present invention.
Figure 3:
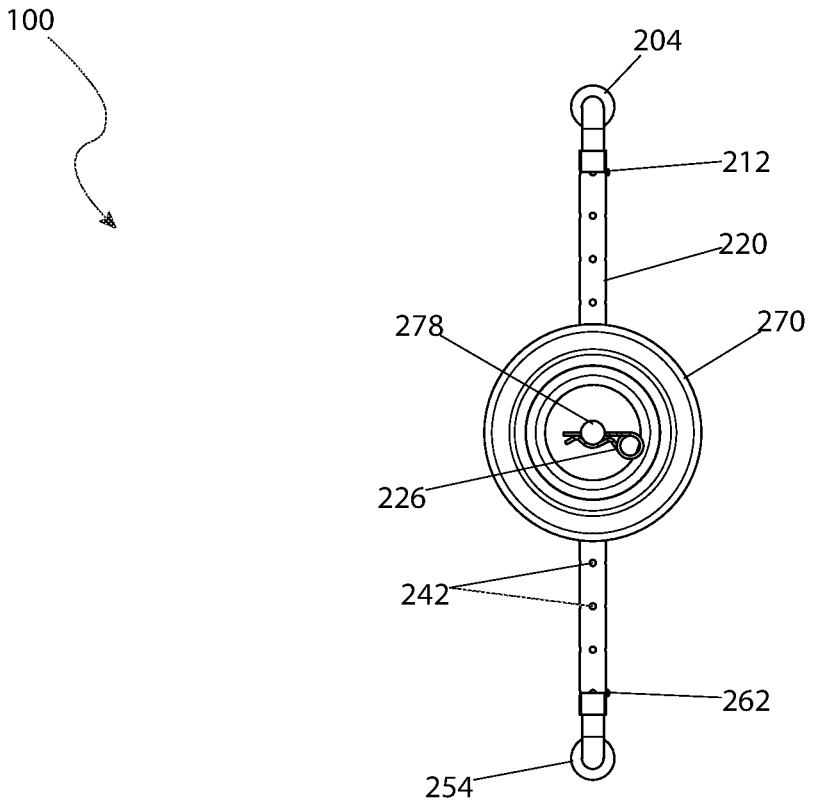
FIG. 3 is a left side view of an abdominal exerciser, according to an embodiment of the present invention.
Figure 4:
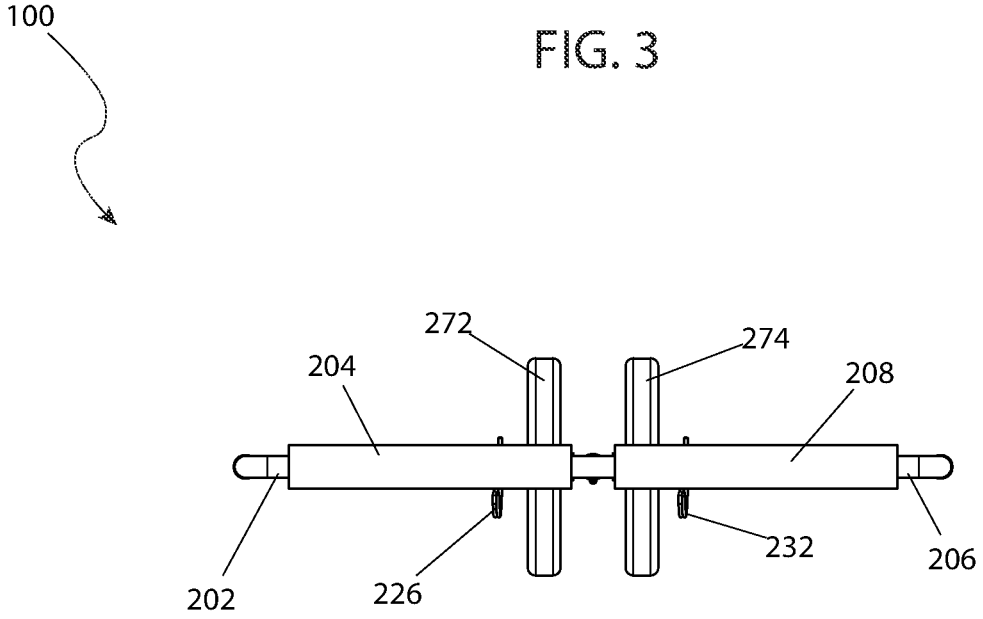
FIG. 4 is a top view of an abdominal exerciser, according to an embodiment of the present invention.

| DESCRIPTIVE KEY | |
|---|---|
| 100 | abdominal exerciser |
| 200 | upper armature |
| 202 | left handle |
| 204 | left handle pad |
| 206 | right handle |
| 208 | right handle pad |
| 210 | upper vertical armature |
| 212 | upper height adjusters |
| 218 | handle downturn |
| 220 | central bar |
| 222 | left weight rod |
| 224 | left retainer hole |
| 226 | left retainer pin |
| 228 | right weight rod |
| 230 | right retainer hole |
| 232 | right retainer pin |
| 240 | plurality of height adjustment apertures |
| 242 | first set of height adjustment apertures |
| 244 | second set of height adjustment apertures |
| 250 | lower armature |
| 252 | left foot |
| 254 | left foot pad |
| 256 | right foot |
| 258 | right foot pad |
| 260 | lower vertical armature |

-continued

| DESCRIPTIVE KEY | |
|---|---|
| 262 | lower height adjusters |
| 270 | weight disc |
| 272 | left side weight |
| 274 | right side weight |
| 278 | central weight aperture |

DESCRIPTION OF THE INVENTION

The present invention is directed to an abdominal exerciser (herein described as the "invention") 100. The invention 100 may comprise an upper armature 200, a lower armature 250, a central bar 220, and a plurality of weight discs 270. The invention 100 may be adapted to be lifted by a user in order to perform one or more resistance training exercises. The upper armature 200 may be adapted to be grasped by the user while the user lifts the invention 100. The plurality of weight discs 270 may detachably couple to the central bar 220 in order to establish the amount of resistance to lifting. The lower armature 250 may elevate the plurality of weight discs 270 and the upper armature 200. The vertical height of the plurality of weight discs 270 and the upper armature 200 be telescopically adjusted for the comfort and safety of the user. The invention 100 may be suspended from a pair of hooks of an equipment stand when not in use.

The upper armature 200 may be a tee-shaper armature located at the top of the invention 100. The upper armature 200 may comprise a left handle 202, a right handle 206, and an upper vertical armature 210. The upper vertical armature 210 may be a vertically-oriented shaft. The outside diameter of the upper vertical armature 210 may be smaller than the inside diameter of the central bar 220 such that the upper vertical armature 210 may slide up and down within the central bar 220. The left handle 202 and the right handle 206 may be horizontally-oriented colinear shafts. The right end of the left handle 202 and the left end of the right handle 206 may be coupled to the top of the upper vertical armature 210.

The left handle 202 may comprise a left handle pad 204 and the right handle pad 206. The left handle pad 204 and a right handle pad 208 may cushion the left handle 202 and the right handle 206, respectively.

The upper vertical armature 210 may comprise one (1) or more upper height adjusters 212. As a non-limiting example, the upper height adjusters 212 may be spring-loaded buttons that engage one (1) or more apertures located on the central bar 220 in order to retain the upper vertical armature 210 at a fixed vertical position relative to the central bar 220.

The left handle 202 and the right handle 206 may each comprise a handle downturn 218. The handle downturn 218 may be a right-angle downward bend at the distal end of the left handle 202 and the right handle 206. The handle downturns 218 may be operable to prevent limit laterally sliding of the upper armature 200 by interfering with the pair of hooks on the equipment stand as the upper armature 200 slides.

The lower armature 250 may be an inverted tee-shaper armature located at the bottom of the invention 100. The lower armature 250 may comprise a left foot 252, a right foot 256, and a lower vertical armature 260. The lower vertical armature 260 may be a vertically-oriented shaft. The outside diameter of the lower vertical armature 260 may be smaller than the inside diameter of the central bar 220 such that the lower vertical armature 260 may slide up and down within the central bar 220. The left foot 252 and the right foot 256 may be horizontally-oriented colinear shafts. The right end of the left foot 252 and the left end of the right foot 256 may be coupled to the bottom of the lower vertical armature 260.

The left foot 252 may comprise a left foot pad 254 and the right foot 256. The left foot pad 254 and a right foot pad 258 may cushion the left foot 252 and the right foot 256, respectively.

The lower vertical armature 260 may comprise one (1) or more lower height adjusters 262. As a non-limiting example, the lower height adjusters 262 may be spring-loaded buttons that engage one (1) or more apertures located on the central bar 220 in order to retain the lower vertical armature 260 at a fixed vertical position relative to the central bar 220.

In some embodiments, the lower armature 250 may be a mirror of the upper armature 200 such that identical subassemblies may be used as the upper armature 200 and the lower armature 250.

The central bar 220 may be a hollow vertically-oriented shaft. The upper armature 200 may couple to the upper end of the central bar 220 and the lower armature 250 may couple to the bottom end of the central bar 220. The central bar 220 may comprise a plurality of height adjustment apertures 240. The plurality of height adjustment apertures 240 may be dispersed over the upper and lower halves of the central bar 220 such that the one or more upper height adjusters 212 may engage the plurality of height adjustment apertures 240 located on the upper half of the central bar 220 and the one or more lower height adjusters 262 may engage the plurality of height adjustment apertures 240 located on the lower half of the central bar 220. The plurality of height adjustment apertures 240 may be arranged in pairs located on opposite sides of the central bar 220. In some embodiments, the plurality of height adjustment apertures 240 may comprise a first set of height adjustment apertures 242 and a second set of height adjustment apertures 244. The first set of height adjustment apertures 242 may be radially separated from the second set of height adjustment apertures 244 by 90 degrees such that the upper armature 200 may be rotated to be orthogonal with the lower armature 250, or vice versa.

The central bar 220 may further comprise a left weight rod 222 and a right weight rod 228. The left weight rod 222 and the right weight rod 228 may be horizontally-oriented colinear shafts extending from the center of the central bar 220. The left weight rod 222 and the right weight rod 228 may be operable to retain the plurality of weight discs 270. One (1) or more of the plurality of weight discs 270 may slide onto the left weight rod 222 and the right weight rod 228 by passing the left weight rod 222 and the right weight rod 228 through central weight apertures 278 of the plurality of weight discs 270. The left weight rod 222 may comprise a left retainer hole 224. A left retainer pin 226 may be coupled to the left weight rod 222 via the left retainer hole 224 to retain the plurality of weight discs 270 on the left weight rod 222. The right weight rod 228 may comprise a right retainer hole 230. A right retainer pin 232 may be coupled to the right weight rod 228 via the right retainer hole 230 to retain the plurality of weight discs 270 on the right weight rod 228.

The plurality of weight discs 270 may be weightlifting weights that may be coupled to the left weight rod 222 and to the right weight rod 228 to adjust the overall weight of the invention 100. One (1) or more left side weights 272 may be retained on the left weight rod 222 and one (1) or more right side weights 274 may be retained on the right weight rod 228. An individual weight selected from the plurality of weight discs 270 may comprise the central weight aperture 278. The individual weight may be placed onto the invention 100 by sliding the left weight rod 222 or the right weight rod 228 through the central weight aperture 278.

The invention 100 may be adapted to tighten core abdominal muscles and strengthen upper body muscles by grasping the left handle 202 and the right handle 206 while in a standing position, lifting the upper armature 200 to shoulder height, and returning the lower armature 250 to the ground to complete one (1) repetition. Two (2) or more repetitions may comprise a resistance training session. The resistance training sessions may be performed one (1) or more times per day and may be repeated three or four days (3 or 4 d) per week.

In use, the vertical positions of the upper armature 200 and the lower armature 250 may be adjusted based upon the height of the user. The vertical positions of the upper armature 200 and the lower armature 250 may be adjusted using the one or more upper height adjusters 212 to reposition the upper armature 200 relative to the central bar 220 and by using the one or more lower height adjusters 262 to reposition the lower armature 250 relative to the central bar 220. The plurality of weight discs 270 may be selected and coupled to the left weight rod 222 and the right weight rod 228 by sliding the one or more left side weights 272 onto the left weight rod 222 and by sliding the one or more right side weights 274 onto the right weight rod 228. The one or more left side weights 272 may be retained by coupling the left retainer pin 226 to the left weight rod 222. The one or more right side weights 274 may be retained by coupling the right retainer pin 232 to the right weight rod 228.

The user may grasp the left handle 202 and the right handle 206 while in the standing position, may lift the upper armature 200 to shoulder height, and may return the lower armature 250 to the ground to complete one (1) repetition. Two (2) or more repetitions may comprise the resistance training session. The resistance training sessions may be performed one (1) or more times per day and may be repeated three or four days (3 or 4 d) per week. As a non-limiting example, the invention 100 may be stored when not in use by hanging the left handle 202 and the right handle 206 on a pair of hooks of an equipment stand.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An abdominal exerciser, comprising:

an upper armature having a first handle, a second handle, and an upper vertical armature;

a central bar having a plurality of height adjustment apertures disposed on an upper half and a lower half of the central bar such that one or more upper height adjusters engage the height adjustment apertures located on the upper half of the central bar and one or more lower height adjusters engage the height adjustment apertures located on the lower half of the central bar;

a plurality of weight discs detachably coupled to the central bar in order to establish an amount of resistance to lifting; and a lower armature elevating the weight discs and the upper armature.

2. The abdominal exerciser, according to claim 1, wherein the upper armature is adapted to be grasped by a user while the user lifts the abdominal exerciser.

3. The abdominal exerciser, according to claim 2, wherein the abdominal exerciser is adapted to tighten a plurality of core abdominal muscles and strengthen a plurality of upper body muscles.

4. The abdominal exerciser, according to claim 1, wherein an outside diameter of the upper vertical armature is smaller than an inside diameter of the central bar such that the upper vertical armature slides up and down within the central bar.

5. The abdominal exerciser, according to claim 1, wherein the upper armature is a tee-shaped armature.

6. The abdominal exerciser, according to claim 1, wherein the first handle and the second handle are horizontally-oriented colinear shafts.

7. The abdominal exerciser, according to claim 1, wherein a second end of the first handle and a first end of the second handle are coupled on top of the upper vertical armature.

8. The abdominal exerciser, according to claim 1, wherein the first handle includes a first handle pad and the second handle includes a second handle pad to cushion the first handle and the second handle, respectively.

9. The abdominal exerciser, according to claim 1, wherein the upper vertical armature includes the one or more upper height adjusters that engage one or more apertures located on the central bar in order to retain the upper vertical armature at a fixed vertical position relative to the central bar.

10. The abdominal exerciser, according to claim 9, wherein the one or more upper height adjusters are one or more spring-loaded buttons.

11. The abdominal exerciser, according to claim 1, wherein the first handle and the second handle each includes a handle downturn that is a second-angle downward bend at a distal end of the first handle and the second handle.

12. The abdominal exerciser, according to claim 1, wherein the height adjustment apertures are arranged in pairs located on opposite sides of the central bar.

13. The abdominal exerciser, according to claim 1, wherein a first set of height adjustment apertures are radially separated from a second set of height adjustment apertures by 90 degrees such that the upper armature is rotated to be orthogonal with the lower armature.

14. The abdominal exerciser, according to claim 1, wherein a vertical height of the weight discs and the upper armature is telescopically adjusted for comfort and safety.

15. The abdominal exerciser, according to claim 11, wherein the handle downturns are operable to prevent or limit lateral sliding of the upper armature by interfering with a pair of hooks on an equipment stand as the upper armature slides.

16. The abdominal exerciser, according to claim 1, wherein the central bar includes a first weight rod and a second weight rod that are horizontally-oriented colinear shafts extending from the center of the central bar.

17. The abdominal exerciser, according to claim 16, wherein the first weight rod and the second weight rod are operable to retain the weight discs.

18. The abdominal exerciser, according to claim 16, wherein the weight discs slide onto the first weight rod and the second weight rod by passing the first weight rod and the second weight rod through a plurality of central weight apertures of the weight discs.

19. The abdominal exerciser, according to claim 16, wherein the first weight rod includes a first retainer hole and a first retainer pin coupled to the first weight rod via the first retainer hole to retain the weight discs on the first weight rod.

20. The abdominal exerciser, according to claim 16, wherein the second weight rod includes a second retainer hole and a second retainer pin coupled to the second weight rod via the second retainer hole to retain the weight discs on the second weight rod.

* * * * *